US010232580B2

(12) United States Patent
Knauf et al.

(10) Patent No.: US 10,232,580 B2
(45) Date of Patent: Mar. 19, 2019

(54) METHODS FOR SECURING A SHRINKABLE FILM TO A PAPERBOARD SUBSTRATE AND METHODS FOR MAKING PAPERBOARD CONTAINERS THEREFROM

(71) Applicant: GPCP IP Holdings LLC, Atlanta, GA (US)

(72) Inventors: Gary Harold Knauf, Bear Creek, WI (US); Cheryl Ann Mocadlo, New London, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 530 days.

(21) Appl. No.: 14/979,191

(22) Filed: Dec. 22, 2015

(65) Prior Publication Data

US 2016/0176143 A1 Jun. 23, 2016

Related U.S. Application Data

(60) Provisional application No. 62/096,349, filed on Dec. 23, 2014.

(51) Int. Cl.
*B31B 17/00* (2006.01)
*B31B 50/62* (2017.01)
(Continued)

(52) U.S. Cl.
CPC ..... *B31B 50/62* (2017.08); *B31B 50/00* (2017.08); *B31B 50/624* (2017.08); *B31B 50/64* (2017.08);
(Continued)

(58) Field of Classification Search
CPC ..... B31B 50/62; B31B 50/624; B31B 50/64; B31B 2105/00; B31B 2105/0022;
(Continued)

(56) References Cited

U.S. PATENT DOCUMENTS 3,237,834 A 3/1966 Davis et al.
3,246,745 A 4/1966 Stoker, Jr.
(Continued)

FOREIGN PATENT DOCUMENTS

JP 06-219474 A 8/1994
JP 2006044723 A 2/2006
(Continued)

OTHER PUBLICATIONS

International Search Report of PCT/US2015/067517, dated by the International Searching Authority on Apr. 29, 2016.
(Continued)

*Primary Examiner* — Hemant M Desai
*Assistant Examiner* — Valentin Neacsu

(57) ABSTRACT

Methods for securing a shrinkable film to a paperboard substrate and methods for making paperboard containers therefrom. In one or more embodiments, a band of adhesive may be applied about a perimeter of a paperboard substrate having a first edge and a second edge opposed to one another and a third edge and a fourth edge opposed to one another. The band of adhesive may at least partially surround a first area that is substantially free from the adhesive. A second area that may be substantially free from the adhesive may be located between the third edge and the first area. The first area and the second area may be separated by the band of adhesive. A shrinkable film may be secured to the paperboard substrate with the adhesive to produce a paperboard blank. The third edge and the fourth edge may be overlapped to form a sidewall. A bottom panel may be secured to the sidewall at or adjacent the second edge. The first edge may be curled to form a brim.

20 Claims, 4 Drawing Sheets

(51) Int. Cl.

| | |
|---|---|
| ***B31B 50/00*** | (2017.01) |
| *B31B 50/64* | (2017.01) |
| *B31B 105/00* | (2017.01) |
| *B31B 110/10* | (2017.01) |
| *B31B 110/20* | (2017.01) |
| *B31B 120/40* | (2017.01) |

(52) U.S. Cl.
CPC ..... *B31B 2105/00* (2017.08); *B31B 2105/001* (2017.08); *B31B 2110/10* (2017.08); *B31B 2110/20* (2017.08); *B31B 2120/40* (2017.08)

(58) Field of Classification Search
CPC ..... B31B 2105/001; B31B 2110/10; B31B 2110/20; B65D 81/3869; B65D 81/3823; B65D 81/3865; B65D 81/3874; B65D 3/04; B65D 3/06; B65D 3/22; B65D 1/22; B65D 1/26; B65D 1/265; B65D 1/28
USPC ..... 493/52, 56, 82, 108, 110, 150, 153–155, 493/379; 156/163, 272.8; 220/592.2, 220/400
See application file for complete search history.

(56) References Cited

U.S. PATENT DOCUMENTS

| | | | | |
|---|---|---|---|---|
| 3,669,337 | A | 6/1972 | Struble | |
| 4,087,003 | A | 5/1978 | Adamek | |
| 4,194,039 | A | 3/1980 | Mueller | |
| 4,459,793 | A | 7/1984 | Zenger | |
| 4,551,366 | A | 11/1985 | Maruhashi et al. | |
| 4,923,557 | A | 5/1990 | Dickey | |
| 4,952,451 | A | 8/1990 | Mueller | |
| 4,971,845 | A | 11/1990 | Aaker et al. | |
| 4,982,872 | A | 1/1991 | Avery | |
| 4,985,300 | A | 1/1991 | Huang | |
| 5,001,016 | A | 3/1991 | Kondo et al. | |
| 5,063,005 | A | 11/1991 | Doheny, Jr. | |
| 5,145,107 | A | 9/1992 | Silver et al. | |
| 5,279,872 | A | 1/1994 | Ralph | |
| 5,469,983 | A | 11/1995 | Yawata | |
| 5,691,049 | A | 11/1997 | Morita et al. | |
| 5,707,751 | A | 1/1998 | Garza et al. | |
| 5,851,610 | A | 12/1998 | Ristey et al. | |
| 6,224,954 | B1 | 5/2001 | Mitchell et al. | |
| 6,253,995 | B1 | 7/2001 | Blok et al. | |
| 6,364,149 | B1 | 4/2002 | Smith | |
| 6,536,657 | B2 | 3/2003 | Van Handel | |
| 6,729,534 | B2 | 5/2004 | Van Handel | |
| 6,872,462 | B2 | 3/2005 | Roberts et al. | |
| 6,908,687 | B2 | 6/2005 | Mendes et al. | |
| 7,464,856 | B2 | 12/2008 | Van Handel | |
| 7,464,857 | B2 | 12/2008 | Van Handel | |
| 7,510,098 | B2 * | 3/2009 | Hartjes | B65D 81/3869 220/592.2 |
| 7,513,386 | B2 | 4/2009 | Hartjes et al. | |
| 7,600,669 | B2 | 10/2009 | Van Handel | |
| 7,614,993 | B2 | 11/2009 | Van Handel | |
| 7,811,644 | B2 | 10/2010 | DeBraal et al. | |
| 7,841,974 | B2 * | 11/2010 | Hartjes | B65D 81/3869 493/153 |
| 7,913,873 | B2 | 3/2011 | Van Handel | |
| 7,938,313 | B1 | 5/2011 | Van Handel | |
| 8,286,824 | B2 | 10/2012 | Ikeda et al. | |
| 9,168,714 | B2 * | 10/2015 | Fike | B65D 81/3869 |
| 2003/0015582 | A1 | 1/2003 | Handel | |
| 2003/0021921 | A1 | 1/2003 | Debraal et al. | |
| 2003/0121963 | A1 | 7/2003 | Van Handel | |
| 2004/0170814 | A1 | 9/2004 | Van Handel | |
| 2005/0184074 | A1 | 8/2005 | Simmons et al. | |
| 2006/0281618 | A1 | 12/2006 | Hollis et al. | |
| 2006/0281619 | A1 | 12/2006 | Hollis et al. | |
| 2006/0283855 | A1 | 12/2006 | Hollis et al. | |
| 2007/0000931 | A1 | 1/2007 | Hartjes et al. | |
| 2007/0029332 | A1 * | 2/2007 | Hartjes | B65D 81/3869 220/592.2 |
| 2007/0114271 | A1 | 5/2007 | Van Handel | |
| 2007/0262129 | A1 | 11/2007 | Zadravetz | |
| 2008/0093434 | A1 | 4/2008 | Van Handel | |
| 2009/0170679 | A1 * | 7/2009 | Hartjes | B65D 81/3869 493/56 |
| 2010/0224529 | A1 | 9/2010 | Forloni | |
| 2010/0224637 | A1 | 9/2010 | Ikeda et al. | |
| 2011/0031305 | A1 * | 2/2011 | Pounder | B65D 81/3869 229/403 |
| 2011/0114645 | A1 | 5/2011 | Yawata | |
| 2012/0312869 | A1 * | 12/2012 | Fike | B65D 81/3869 229/400 |
| 2013/0341387 | A1 * | 12/2013 | Fike | B65D 1/265 229/400 |
| 2017/0225423 | A1 | 8/2017 | Knauf et al. | |

FOREIGN PATENT DOCUMENTS

| | | | |
|---|---|---|---|
| JP | 2006160346 | A | 6/2006 |
| JP | 2011116411 | A | 6/2011 |
| JP | 2011116412 | A | 6/2011 |
| WO | 2012160682 | A1 | 11/2012 |

OTHER PUBLICATIONS

Written Opinion of PCT/US2015/067517, dated by the International Searching Authority on Apr. 29, 2016.
International Search Report of PCT/US2015/000448, dated by the International Searching Authority on Apr. 6, 2016.
Written Opinion of PCT/US2015/000448, dated by the International Searching Authority on Apr. 6, 2016.
Clysar LE Summary of Properties, Feb. 1, 2003, three pages, http://www.logismarket.com.mx/ip/safte-food-ingredients-pelicula-multicapa-imprimible-de-baja-energia-ficha-tecnica-clysar-le-435253.pdf.
Clysar LLG Summary of Properties, Apr. 7, 2011, three pages, XP055195983, http://www.clysar.com/pdf/Clysar_LLG_PDS.pdf.

* cited by examiner

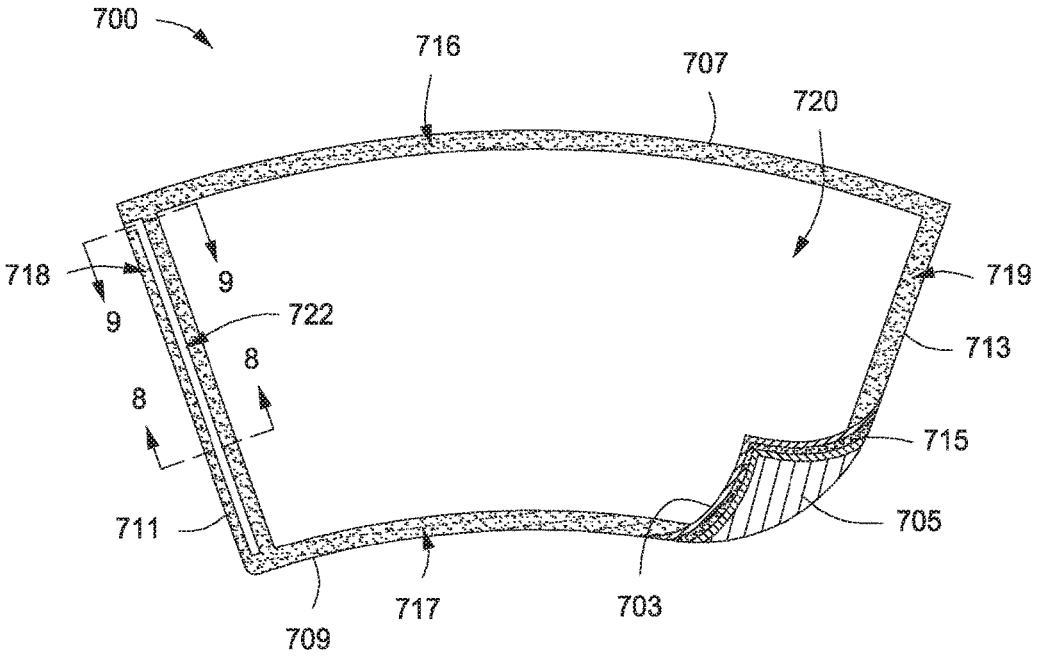
FIG. 7
FIG. 8
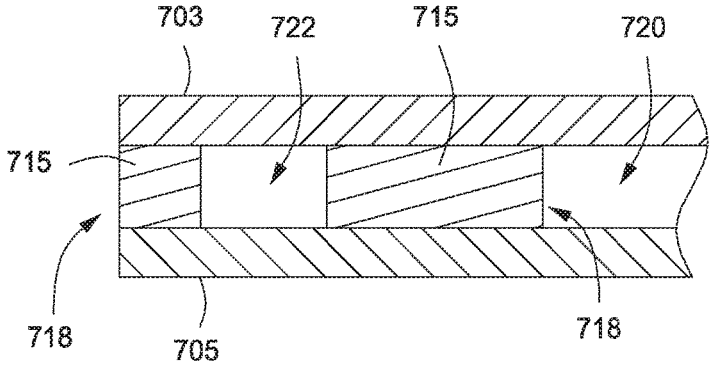
FIG. 9
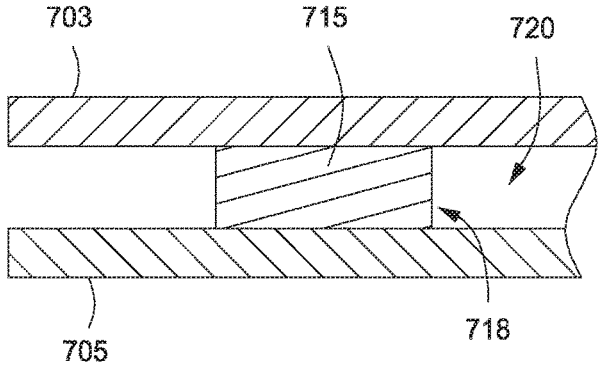

METHODS FOR SECURING A SHRINKABLE FILM TO A PAPERBOARD SUBSTRATE AND METHODS FOR MAKING PAPERBOARD CONTAINERS THEREFROM

CROSS-REFERENCE TO RELATED APPLICATION

This application claims priority to U.S. Provisional Patent Application No. 62/096,349, filed on Dec. 23, 2014, which is incorporated by reference herein.

BACKGROUND

Field

Embodiments described generally relate to methods for securing a shrinkable film to a paperboard substrate and methods for making paperboard containers therefrom.

Description of the Related Art

Paperboard is used to make a wide variety of paper products, such as plates, bowls, and cups. Paper products may be insulated in a variety of ways to provide an insulated product, such as an insulated cup for hot or cold beverages. For example, the paper product may be insulated by forming an air gap within a sidewall of the container. The air gap, for example, may be located between a film that forms an inner surface of the sidewall and a paperboard substrate that forms an outer surface of the sidewall. The film may be a shrinkable film that may shrink, e.g., a heat shrinkable film, to form the gap between the film and the paperboard substrate as the film shrinks.

Typically the paperboard blank that the shrinkable film is adhered to includes an outer and an inner coating of low density polyethylene or other polymer. When a composite structure includes paperboard and a shrink film to form an insulated container, a potential defect is that a shrink force induced by the shrink film may cause delamination within the paperboard component of the substrate. The layer of paperboard fibers which are adhered to the shrink film are peeled away as the film shrinks, producing an effect generally referred to as "peel back." Once the film peels back, the paperboard fibers are exposed and will begin to absorb liquid, e.g., coffee, if present in the container. The absorption and migration of the liquid into the paperboard blank used to form the container is generally referred to as "edge wicking." The absorption of the liquid may reduce the structural integrity of the paperboard blank, is not aesthetically pleasing, and is generally undesirable.

There is a need, therefore, for improved methods for securing a shrinkable film to a paperboard substrate and methods for making paperboard containers therefrom that have a reduced degree of peel back of the shrinkable film along an inner sidewall seam thereof.

SUMMARY

Methods for securing a shrinkable film to a paperboard substrate and methods for making paperboard containers therefrom are provided. In at least one specific embodiment, a method for making a paper container may include applying a band of adhesive about a perimeter of a paperboard substrate having a first edge and a second edge opposed to one another and a third edge and a fourth edge opposed to one another. The band of adhesive may at least partially surround a first area that is substantially free from the adhesive. A second area that is substantially free from the adhesive may be located between the third edge and the first area. The first area and the second area may be separated by the band of adhesive. A shrinkable film may be secured to the paperboard substrate with the adhesive to produce a paperboard blank. The third edge and the fourth edge may be overlapped to form a sidewall. The sidewall may include an inner surface that includes the shrinkable film and an outer surface that includes the paperboard substrate, the first edge, and the second edge. A bottom panel may be secured to the sidewall at or adjacent the second edge. The first edge may be curled to form a brim.

In at least one specific embodiment, a method for making a paper container may include applying a band of adhesive about a perimeter of a paperboard substrate having a first edge and a second edge opposed to one another and a third edge and a fourth edge opposed to one another. The band of adhesive may surround a first area that is substantially free of the adhesive. A second area that is substantially free of the adhesive may be formed between the third edge and the first area. The first area and the second area may be separated by the band of adhesive. A shrinkable film may be secured to the paperboard substrate with the adhesive to produce a paperboard blank. The third edge and the fourth edge may be overlapped to form a sidewall. The sidewall may include an inner surface that includes the shrinkable film and an outer surface that includes the paperboard substrate, the first edge, and the second edge. A bottom panel may be secured to the sidewall at or adjacent the second edge of the sidewall. The first edge of the sidewall may be curled to form a brim.

In at least one specific embodiment, a method for making a paper container may include applying a band of adhesive about a perimeter of a paperboard substrate having a first edge and a second edge opposed to one another and a third edge and a fourth edge opposed to one another. The band of adhesive may at least partially surround a first area that is substantially free from the adhesive. A second area that is substantially free from the adhesive may be located between the third edge and the first area. The first area and the second area may be separated by at least a portion of the band of adhesive. A shrinkable film may be secured to the paperboard substrate with the adhesive to produce a paperboard blank. The third edge and the fourth edge may be overlapped with one another. The third edge and the fourth edge may be heat sealed to one another to form a sidewall. A bottom panel may be secured to the sidewall at or adjacent the second edge. The first edge may be curled to form a brim.

BRIEF DESCRIPTION OF THE DRAWINGS

FIG. 7 depicts a schematic view of another illustrative paperboard blank for making a cup, according to one or more embodiments described.

FIG. 8 depicts a schematic cross-sectional view of the paperboard blank depicted in FIG. 7 along line 8-8, according to one or more embodiments described.

FIG. 9 depicts a schematic cross-sectional view of the paperboard blank depicted in FIG. 7 along line 9-9, according to one or more embodiments described.

DETAILED DESCRIPTION

Figure 1:
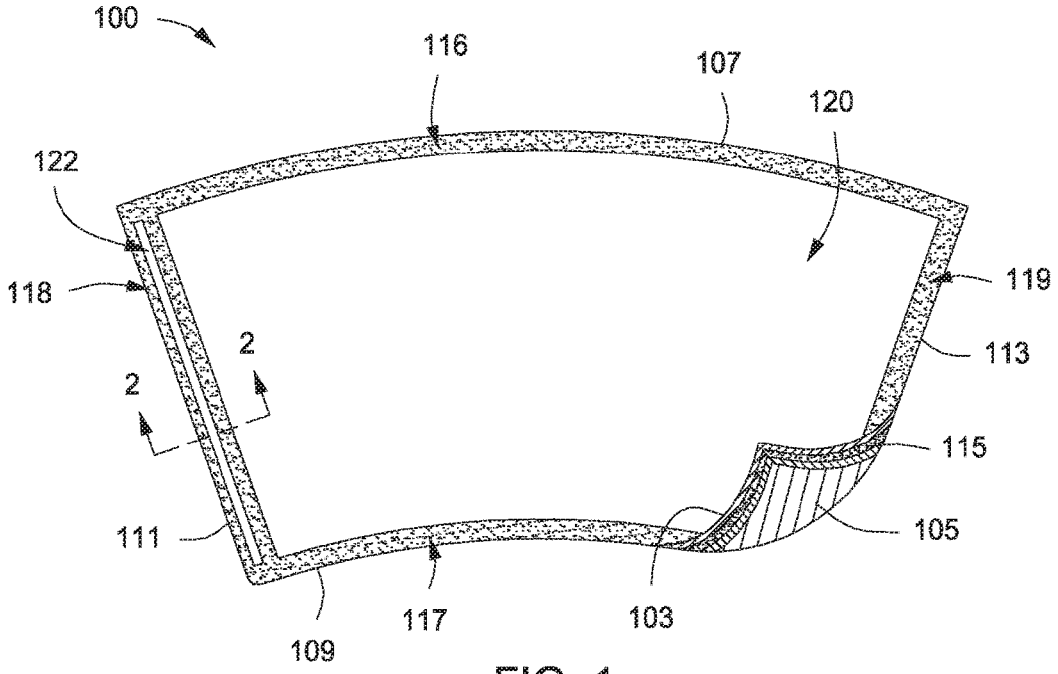
FIG. 1 depicts a schematic view of an illustrative paperboard blank for making a cup, according to one or more embodiments described.
Figure 2:
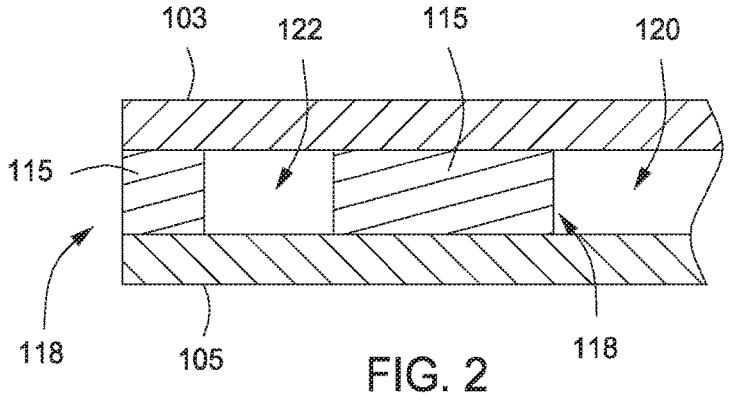
FIG. 2 depicts a schematic cross-sectional view of the paperboard blank depicted in FIG. 1 along line 2-2, according to one or more embodiments described.

FIG. 1 depicts a schematic view of an illustrative paperboard blank 100 for making a cup, according to one or more embodiments, and FIG. 2 depicts a schematic cross-sectional view of the paperboard blank 100 depicted in FIG. 1 along line 2-2. Referring to FIGS. 1 and 2, the paperboard blank 100 may include a first layer or film 103 and a second layer or substrate 105. The film 103 and the substrate 105 may be secured to one another using any suitable method. For example, the film 103 and the substrate 105 may be at least partially bonded, coupled, affixed, joined, fastened, attached, connected, or otherwise secured to one another with an adhesive 115. In another example, the film 103 and the substrate 105 may be at least partially bonded, coupled, affixed, joined, fastened, attached, connected, or otherwise secured to one another via ultrasonic bonding. In one or more embodiments, the film 103 may be a shrinkable film and the substrate 105 may be a paperboard substrate. For simplicity and ease of description, embodiments provided herein will be further described with reference to a shrinkable film 103 and a paperboard substrate 105. When the substrate 105 is a paperboard substrate, the paperboard blank 100 may be formed into a paper product, such as a bowl, plate, container, tray, platter, deep dish container, fluted product, or cup. The terms "paper product," "paper containers," "paperboard products," and "paperboard containers" are intended to be interchangeable. For simplicity and ease of description, embodiments provided herein will be further described with reference to a paper cup.

The paperboard blank 100 may have a first or "top" edge 107, a second or "bottom" edge 109, a third or "left" edge 111, and a fourth or "right" edge 113. The particular shape of the paperboard blank 100 may depend, at least in part, on the particular container to be made from the paperboard blank 100. For example, the paperboard blank 100 depicted in FIG. 1 has arcuate first and second edges 107, 109 and straight third and fourth edges 111, 113 with the first and second edges 107, 109 generally opposed to one another and the third and fourth edges 111, 113 generally opposed to one another.

The adhesive 115 may be disposed between the shrinkable film 103 and the paperboard substrate 105. For example, the shrinkable film 103 may be secured to the paperboard substrate 105 with the adhesive 115 about at least a portion of an area or region along a perimeter, e.g., edges 107, 109, 111, and 113, of the paperboard substrate 105. In at least one example, the adhesive 115 may be applied about or along the first edge 107, the second edge 109, the third edge 111, and the fourth edge 113 to form a band of adhesive 115 about the perimeter of the paperboard substrate. As used herein, the term "band" refers to a generally thin and generally flat strip of material, e.g., a generally thin and a generally flat strip of the adhesive 115.

The adhesive 115 along the first edge 107 may extend from the third edge 111 to the fourth edge 113 and toward the second edge 109 to form a first portion 116 of the band of adhesive 115. The adhesive 115 along the second edge 109 may extend from the third edge 111 to the fourth edge 113 and toward the first edge 107 to form a second portion 117 of the band of adhesive 115. The adhesive 115 along the third edge 111 may extend from the first portion 116 of the band of adhesive 115 to the second portion 117 of the band of adhesive 115 and toward the fourth edge 113 to form a third portion 118 of the band of adhesive 115. The adhesive 115 along the fourth edge 113 may extend from the first portion 116 of the band of adhesive 115 to the second portion 117 of the band of adhesive 115 and toward the third edge 111 to form a fourth portion 119 of the band of adhesive 115. Accordingly, the first portion 116, the second portion 117, the third portion 118, and the fourth portion 119 may form a continuous band of adhesive 115 about the perimeter of the paperboard substrate 105.

The first portion 116, the second portion 117, the third portion 118, and the fourth portion 119 of the band of adhesive 115 may surround or at least partially surround a first region or area 120 that may be free or substantially free from the adhesive 115. The adhesive 115 along the third edge 111, e.g., the third portion 118 of the band of adhesive 115, may include a second region or area 122 between the first edge 107 and the second edge 109 that may be free or substantially free from any adhesive 115. The second area 122 may be located within the third portion 118 of the band of adhesive 115 (as shown in FIGS. 1 and 2) or adjacent to the third portion 118 of the band of adhesive 115 (not shown). It should be noted that the first portion 116, the second portion 117, and/or the fourth portion 119 of the band of adhesive 115 may include one or more interior areas similar to the second area 122 that may be located within and/or adjacent to the first portion 116, the second portion 117, and/or the fourth portion 119 of the band of adhesive 115.

The second area 122 may have a length that extends from the first portion 116 of the band of adhesive 115 to the second portion 117 of the band of adhesive 115. As such, the first portion 116, the second portion 117, and the third portion 118 of the band of adhesive 115 may form or otherwise provide a continuous layer or band of the adhesive 115 that extends from the first edge 107 to the second edge 109 that includes the second area 122 disposed therein. In one or more embodiments, the second area 122 may extend for a distance that is less than the distance between the first portion 116 of the band of adhesive 115 and the second portion 117 of the band of adhesive 115. For example, the length of the second area 122 may range from a low of about 50%, about 55%, or about 60% to a high of about 90%, about 95%, or about 99% of the distance between the first portion 116 of the band of adhesive 115 and the second portion 117 of the band of adhesive 115. In one or more embodiments, the second area 122 may extend from the first edge 107 to the second portion 117 of the band of adhesive 115, from the second edge 109 to the first portion 116 of the band of adhesive 115, or from the first edge 107 to the second edge 109.

In one or more embodiments, the width of the second area 122 may range from a low of about 0.5 mm, about 1 mm, about 2 mm, or about 3 mm to a high of about 5 mm, about 8 mm, about 10 mm, or about 12 mm or more. In one or more embodiments, the side of the second area 122 adjacent or proximate to the third edge 111 may be located from the third edge 111 a distance ranging from a low of about 0.5 mm, about 1 mm, or about 2 mm to about 3 mm, about 4 mm, about 6 mm, about 8 mm, or about 10 mm or more. The side of the second area 122 closest to the fourth edge 113 may be located from the third edge 111 a distance ranging from a low of about 1 mm, about 3 mm, or about 5 mm to a high of about 7 mm, about 9 mm, about 11 mm, about 13 mm, or about 15 mm or more. The width of the third portion 118 of the band of adhesive 115 located between the second area 122 and the first area 120 may range from a low of about 1 mm, about 2 mm, or about 3 mm to a high of about 5 mm, about 7 mm, about 9 mm, about 11 mm, about 13 mm, or about 15 mm or more.

As noted above, the second area 122 may be located within or adjacent the fourth portion 119 of the band of adhesive 115 rather than, or in addition to, being located within the third portion 118 of the band of adhesive 115. If the second area 122 is located within the fourth portion 119, the second area 122 may have the same dimensions as those discussed and described for the second area 122 located within the third portion 118 of the band of adhesive 115. Similarly, if the second area 122 is located within the fourth portion 119, the second area 122 may be located within the fourth portion 119 of the band of adhesive 115 relative to the fourth edge 113 in the same manner as discussed and described for the second area 122 located within the third portion 118 of the band of adhesive 115.

The first interior or first inner region 120 between the shrinkable film 103 and the paperboard substrate 105, similar to the second interior or second inner region 122, may be free or substantially free from the adhesive 115 such that the shrinkable film 103 may be free to move away from the paperboard substrate 105 as the shrinkable film 103 shrinks. When the paperboard blank 100 has been formed into a container and the shrinkable film 103 shrinks, a gap may be formed between the film 103 and the paperboard substrate 105 as discussed and described in further detail below with reference to FIG. 6.

As shown in FIG. 1, the adhesive 115 may be disposed between the shrinkable film 103 and the paperboard substrate 105 along the perimeter of the paperboard blank 100. The width of the band of adhesive 115 or "glue line" disposed between the shrinkable film 103 and the paperboard substrate 105 and along the first edge 107, the second edge 109, the third edge 111, and the fourth edge 113 may range from a low of about 1 mm, about 2 mm, or about 3 mm to a high of about 5 mm, about 10 mm, about 20 mm, or about 30 mm or more.

The width of the band of adhesive 115 or glue line along each edge 107, 109, 111, and 113 of the paperboard substrate 105 may be the same or different with respect to one another. Said another way, the width of the first portion 116, the width of the second portion 117, the width of the third portion 118, and the width of the fourth portion 119 of the band of adhesive 115 may be the same or different with respect to one another. For example, the width of the band of adhesive 115 along the first edge 107 may be less than the width of the band of adhesive 115 along the second edge 109, less than the width of the band of adhesive 115 along the third edge 111, and/or less than the width of the band of adhesive 115 along the fourth edge 113. In another example, the width of the band of adhesive 115 along the third edge 111 may be less than the width of the band of adhesive 115 along the first edge 107, less than the width of the band of adhesive 115 along the second edge 109 and/or less than the width of the band of adhesive 115 along the fourth edge 113. In another example, the width of the band of adhesive 115 along the fourth edge 113 may be less than the width of the band of adhesive 115 along the first edge 107, less than the width of the band of adhesive 115 along the second edge 109 and/or less than the width of the band of adhesive 115 along the third edge 111. In another example, the width of the band of adhesive 115 along the first edge 107 may be less than the width of the band of adhesive 115 along the third edge 111, which may be less than the width of the band of adhesive 115 along the fourth edge 113, which may be less than the width of the band of adhesive 115 along the second edge 109.

In one or more embodiments, the first layer or shrinkable film 103 may shrink when subjected to one or more predetermined triggers or conditions. For example, the shrinkable film 103 may be a heat shrinkable film, i.e., a film that shrinks when heated to a sufficient temperature. For example, the shrinkable film 103 may shrink when heated to a temperature of about 40° C. or more, about 80° C. or more, about 90° C., about 100° C. or more. In at least one example, the film 103 may shrink when exposed to a hot liquid. In at least one other example, the film 103 may shrink when heated in an oven, by contact with a flow of heated gas, or other heating means. In at least one other example, the film 103 may shrink when exposed to infrared light, microwaves, or a combination thereof.

The shrink force exerted by the shrinkable film 103 during and after shrinking may pull or otherwise exert a force on the paperboard substrate 105. The adhesive 115 may have a tack or bond strength sufficient to maintain the shrinkable film 103 secured to the paperboard substrate 105. In one or more embodiments, the adhesive 115 may have a tack or bond sufficient to maintain the shrinkable film 103 secured to the paperboard substrate 105 along the first portion 116, the second portion 117, and the fourth portion 119 of the band of adhesive 115, but may permit the shrinkable film 103 secured to the third portion 118 of the band of adhesive 115 between the third edge 111 and the second area 122 to pull up while maintaining the shrinkable film 103 secured to the paperboard substrate 105 via the third portion 118 of the band of adhesive 115 between the second area 122 and the first area 120. The portion of the shrinkable film 103 secured to the third portion 118 of the band of adhesive 115 between the third edge 111 and the second area 122 may pull cleanly away from the paperboard substrate 105 and/or may physically separate or tear fibers away from the paperboard substrate 105 when the shrinkable film 103 shrinks.

It has been surprisingly and unexpectedly discovered that applying the adhesive 115 along the third edge 111 in a configuration or pattern that forms or provides the second area 122 located at, adjacent, or proximate the third edge 111 may significantly reduce or prevent the physical separation or tearing of fibers away from the paperboard substrate when the shrinkable film 103 shrinks. The presence of the second area 122 may permit the portion of the shrinkable film 103 secured to the adhesive 115 located between the third edge 111 and the second area 122, if any, to pull away from or otherwise become unsecured to the paperboard substrate 105, while the remaining portion of the shrinkable film 103 secured to the paperboard substrate 103 between the second area 122 and the first area 120 may remain secured to the paperboard substrate 103.

The adhesive 115 may be applied onto the shrinkable film 103 and/or the paperboard substrate 105 to provide the second area 122 and the first area 120 that may be free or substantially free of any adhesive 115 using any suitable method or combination of methods known in the art. For example, the adhesive 115 may be applied to the paperboard substrate 105 via spraying, brushing, flexographic printing, rotogravure printing, offset printing, screen printing, or any other suitable coating method. Suitable methods for applying the adhesive 115 to the shrinkable film 103 and/or the paperboard substrate 105 may also include those discussed and described in U.S. Pat. Nos. 6,536,657; 6,729,534; 7,464,856; 7,614,993; 7,600,669; 7,464,857; 7,913,873; 7,938,313; 7,513,386; 7,510,098; 7,841,974; 8,622,232 and U.S. Patent Application Publication Nos. 2011/0031305; 2012/0312869; and 2013/0341387.

The adhesive 115 may be a single or one part adhesive or glue. As used herein, the terms "single part" and "one part," when used in conjunction with "adhesive" or "glue," refer to an adhesive or an adhesive system that does not require the addition of a hardener, catalyst, accelerant, or other cure component or agent required to make the adhesive curable. Said another way, the adhesive 115 may include two or more different components, but the adhesive may be of a type that does not require adding a second component to the adhesive to form a curable adhesive. As such, the adhesive 115 may be storage stable for weeks, months, or even years and upon application of the adhesive 115 to the first or second layer, the adhesive 115 may be cured without the need for a hardener, catalyst, accelerator, or other cure agent.

The adhesive 115 may be or include a polyethylene vinyl acetate resin, or any other suitable adhesive or mixture of adhesives. The adhesive 115 may include one or more additives. Illustrative additives may include, but are not limited to, one or more tackifiers. Suitable tackifiers may include, but are not limited to, ethyl p-toluene sulfonamide. In one or more embodiments, the amount of the additive, e.g., the tackifier, if present, may range from a low of about 1 wt %, about 3 wt %, or about 5 wt % to a high of about 10 wt %, about 12 wt %, or about 15 wt %, based on the total weight of the adhesive.

Commercially available adhesives suitable for use as the adhesive 115 discussed and described above and elsewhere herein may include, but are not limited to, AQUENCE® FB 9192 VELOCITY® and AQUENCE® FB 9080 VELOCITY®, both available from Henkel Corporation. It is believed that the AQUENCE® FB 9192 VELOCITY® and AQUENCE® FB 9080 VELOCITY® adhesives are both polyethylene vinyl acetate resins, with the AQUENCE® FB 9192 VELOCITY® including the addition of ethyl p-toluene sulfonamide (tackifier) in an amount of about 5 wt % to about 10 wt %, based on the total weight of the adhesive.

In one or more embodiments, the peel strength required to separate the shrinkable film 103 from the paperboard substrate 105 when secured thereto with the adhesive 115 may be less than about 340 g/2.54 cm, less than about 280 g/2.54 cm, or less than about 220 g/2.54 cm at a temperature of about 23° C. For example, the peel strength required to separate the shrinkable film 103 from the paperboard substrate 105 when secured thereto with the adhesive 115 may range from a low of about 100 g/2.54 cm, about 150 g/2.54 cm, about 200 g/2.54 cm, about 215 g/2.54 cm, or about 235 g/2.54 cm to a high of about 255 g/2.54 cm, about 270 g/2.54 cm, or about 285 g/2.54 cm at a temperature of about 23° C.

The peel strength may be measured according to the following procedure. The shrinkable film 103 and the paperboard substrate 105 may be secured to one another with the adhesive 115 and a 1 inch wide sample may be cut therefrom. The shrinkable film 103 and the paperboard substrate 105 at the end of a sample (not adhered to one another with the adhesive or separated from one another if adhered) may be secured in opposing clamps and pulled apart from one another at an angle of 180°, at a rate of 1 inch per minute, while at a temperature of 23° C. An Instron tensile tester Model 5943 may be used to measure the force with a frequency of 25 data points per second throughout the peel. The average value of the force measured is the peel strength required to separate the shrinkable film 103 from the paperboard substrate 105 when secured thereto with the adhesive 115.

The pattern or configuration of the adhesive 115 discussed and described herein may be used to form blanks 100 suitable for making a paperboard product in which the shrinkable film 103 has a reduced amount of peel back along the third edge 111 from the paperboard substrate 105 when the shrinkable film 103 shrinks as compared to a comparative blank that is the same except the second area 122 is absent. More particularly, the shrinkable film 103 of the comparative blank will exhibit a significantly greater amount of peel back from the paperboard substrate 105 as compared to the amount of peel back the shrinkable film 103 secured to the paperboard substrate 105 with the second area 122 free or substantially free from the adhesive 115.

The shrinkable film 103 may be uniaxially or biaxially oriented. In at least one specific example, the shrinkable film 103 may be a biaxially oriented, heat shrinkable polymeric film. In at least one specific example, the shrinkable film 103 may be a uniaxially oriented, heat shrinkable polymeric film. The shrinkable film 103 may be a mono-layer film or a multi-layer film. A multilayer film 103 may have 2, 3, 4, 5, 6, 7, 8, or more layers. The film 103 may include a core layer or intermediate layer, and one or more outer layers or skin layers such as a first outer layer and a second outer layer. The film 103 may include a core layer or intermediate layer one or more tie layers, and one or more outer layers. For example, the film 103 may include a core layer, a first tie layer and a second tie layer disposed on opposing sides of the core layer, a first outer layer disposed on the first tie layer, and a second outer layer disposed on the second tie layer.

Orientation in the direction of extrusion is known as the machine direction (MD) orientation. Orientation perpendicular to the direction of extrusion is known as the transverse direction (TD) orientation. Orientation may be accomplished by stretching or pulling a film first in the MD followed by the TD orientation. Blown films or cast films may also be oriented by a tenter-frame orientation subsequent to the film extrusion process, again in one or both directions. Orientation may be sequential or simultaneous, depending upon the desired film features. Typical commercial orientation processes may include the biaxially oriented polypropylene (BOPP) tenter process, the blown film process, and the linear motor simultaneous stretching (LISIM) process.

The shrinkable film 103 may be or include a polyolefin film. For example, the shrinkable film 103 may be or include a polyethylene film, a polypropylene film, a polyethylene terephthalate film, a cellophane film, a polyamide film, or any combination thereof. In another example, the shrinkable film 103 may be or include a butylene polymer, ethylene polymer, high density polyethylene (HDPE) polymer, medium density polyethylene (MDPE) polymer, low density polyethylene (LDPE) polymer, linear low density polyethylene (LLDPE), propylene (PP) polymer, isotactic polypropylene (iPP) polymer, high crystallinity polypropylene (HCPP) polymer, ethylene-propylene (EP) copolymers, ethylene-propylene-butylene (EPB) terpolymers, propylene-butylene (PB) copolymer, an ethylene elastomer, ethylene-based plastomer, propylene elastomer and combinations or blends thereof. In another example, the shrinkable film 103 may be or include polyethylene, polypropylene, polyvinylchloride (PVC), polymethylpentene, polybutene-1, polyolefin elastomers, polyisobutylene, ethylene propylene rubber, or any mixture or combination thereof.

The polyolefin film may also include one or more additives. Illustrative additives may include, but are not limited to, tackifiers, waxes, functionalized polymers such as acid modified polyolefins and/or anhydride modified polyolefins, antioxidants, oils, compatabilizers, fillers, adjuvants, adhesion promoters, plasticizers, low molecular weight polymers, blocking agents, antiblocking agents, anti-static agents, release agents, anti-cling additives, colorants, dyes, pigments, processing aids, UV stabilizers, heat stabilizers, neutralizers, lubricants, surfactants, nucleating agents, flexibilizers, rubbers, optical brighteners, colorants, diluents, viscosity modifiers, oxidized polyolefins, and any combination or mixture thereof. Commercially available films that may be used as the shrinkable film 103 may include, but are not limited to, CLYSAR® HPG (HP Gold), CLYSAR® LLGT, CLYSAR® VEZT, CLYSAR® LLG, CLYSAR® ABL, available from Clysar, Clinton, Iowa.

The total thickness of the resulting monolayer and/or multilayer shrinkable film 103 may vary. For example, a total film thickness of about 5 μm to about 50 μm or about 10 μm to about 30 μm may be suitable for most paperboard containers. In another example, the shrinkable film 103 may have a thickness from a low of about 5 μm, about 10 μm, or about 15 μm to a high of about 20 μm, about 25 μm, about 30 μm, or about 35 μm. In one or more embodiments, the thickness of the shrinkable film 103 may be sufficient to reduce or prevent the shrinkable film 103 from breaking, tearing, ripping, or otherwise forming holes therethrough.

In one or more embodiments, a surface area of the shrinkable film 103 may shrink or reduce from an original or starting surface area to a second or final surface area in an amount of about 5%, about 10%, about 15%, about 20%, about 25%, about 30%, about 35%, about 40%, about 45%, about 50%, about 55%, or about 60% based on the original or starting surface area. For example, the surface area of the shrinkable film 103 may shrink or reduce from an original or starting surface area to a second or final surface area in an amount of about 10% to about 30%, about 15% to about 30%, about 8% to about 20%, about 15% to about 35%, about 12% to about 33%, about 25% to about 35%, or about 10% to about 40%. In another example, a heat shrink film having a surface area of about 100 $cm^2$ may be reduced to about 95 $cm^2$, about 90 $cm^2$, about 85 $cm^2$, about 80 $cm^2$, about 75 $cm^2$, about 70 $cm^2$, about 65 $cm^2$, about 60 $cm^2$, about 55 $cm^2$, about 50 $cm^2$, about 45 $cm^2$, or about 40 $cm^2$ when subjected to a temperature of about 40° C. to about 100° C. In at least one specific example, the surface area of the shrinkable film 103 may shrink in an amount of about 30% to about 45%, about 35% to about 50%, about 35% to about 45%, about 40% to about 50%, about 45% to about 55%, about 50% to about 60%, or about 40% to about 60% when heated to a temperature of about 102° C. for a time of 10 minutes. The shrinkage of the shrinkable film 103 may be measured according to ASTM D1204.

The second layer 105 may be or include any paperboard material capable of forming a desired paper container. It should be noted that the second layer 105 may be or include non-paperboard or non-paper based materials such as one or more polymers, e.g., polyolefins, and/or metals, e.g., aluminum. In one or more embodiments, paperboard materials suitable for use as the second layer or substrate 105 may have a basis weight ranging from a low of about 163 grams, about 210 grams, or about 275 grams to a high of about 325 grams, about 400 grams, or about 500 grams per square meter of paperboard substrate. In one or more embodiments, the paperboard material may have a thickness ranging from a low of about 175 μm, about 225 μm, or about 250 μm to a high of about 350 μm, 450 μm, about 600 μm, about 750 μm, or about 1,000 μm.

If the second layer 105 is or includes paperboard, the paperboard may be uncoated or coated with one or more additional materials. For example, the paperboard may be uncoated, e.g., free or substantially free from wax, clay, polyethylene, and other coating material. In another example, a suitable paperboard may be or include paperboard coated with one or more waxes, one or more clays, and/or one or more polyolefins on one or both sides. A paperboard may be coated with polyethylene, for example, using any suitable process. In one example, a polyethylene coating may be applied to the paperboard via an extrusion process. Polyethylene and/or other polymeric materials may be coated onto the paperboard to provide liquid resistance properties and/or serve as a heat sealable coating. A paperboard may be at least partially coated with one or more additional materials on one side or both sides thereof. Suitable polymeric materials that may be used to coat the paperboard may include, but are not limited to, polyethylene, polypropylene, polyester, or any combination thereof. If the paperboard is coated with a material, e.g., wax or polymeric material, the coating may have a thickness ranging from a low of about 0.002 mm, about 0.01 mm, or about 0.1 mm to a high of about 0.15 mm, about 0.2 mm, or about 0.35 mm.

Commercially available paperboard material that may be used as the second layer 105 may include, but is not limited to, solid bleached sulfate (SBS) cupstock, bleached virgin board, unbleached virgin board, recycled bleached board, recycled unbleached board, or any combination thereof. For example, SBS cupstock available from Georgia-Pacific LLC may be used as the second layer 105.

In one or more embodiments, at least a portion of the surface(s) of the shrinkable film 103 and/or the second layer 105, e.g., a paperboard substrate, may be oxidized via corona treatment and/or flame discharge treatment. Oxidizing the surface of the shrinkable film 103 and/or the second layer 105 may increase or raise the surface energy of the treated surface. In one or more embodiments, the shrinkable film 103 may have a surface energy, treated or untreated, greater than about 30 dyne/cm, greater than about 35 dyne/cm, greater than about 38 dyne/cm, greater than about 40 dyne/cm, greater than about 42 dyne/cm, greater than about 44 dyne/cm, or greater than about 46 dyne/cm. In at least one embodiment, the surface of the shrinkable film 103 that contacts the adhesive 115, the surface of the second layer 105 that contacts the adhesive 115, and/or the surface of the second layer 105 that may be coated with ink may be subjected to corona and/or flame treatment.

The method for securing the shrinkable film 103 to the paperboard substrate or second layer 105 may include applying the adhesive 115 to the shrinkable film 103 and/or the second layer 105. The shrinkable film 103 and the second layer 105 may be contacted with one another such that the adhesive 115 may at least partially secure the shrinkable film 103 to the second layer 105. In one or more embodiments, the amount of adhesive 115 applied to the shrinkable film 103 and/or the second layer 105 may range from a low of about 0.04 kg, about 0.1 kg, about 0.5 kg, or about 1.3 kg to a high of about 2 kg, about 3.5 kg, or about 5.5 kg of adhesive 115 per 279 square meters of the shrinkable film 103 or second layer 105. Multiple coatings of the adhesive 115 may be applied to achieve the aforementioned amounts.

The paperboard blank 100 may be formed as part of a paperboard roll (not shown) that includes a plurality of paperboard blanks 100 formed therein. The paperboard blank 100 may be cut from the paperboard roll. A paperboard roll may be formed that includes any suitable number of paperboard blanks formed therein.

Figure 3:
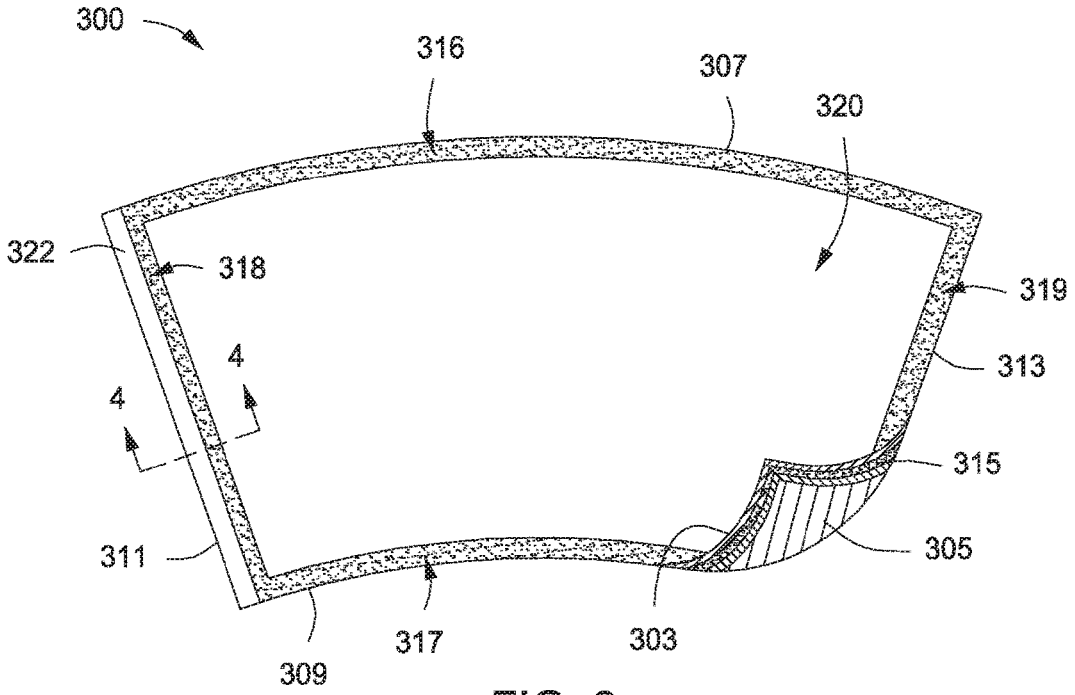
FIG. 3 depicts a schematic view of another illustrative paperboard blank for making a cup, according to one or more embodiments described.
Figure 4:
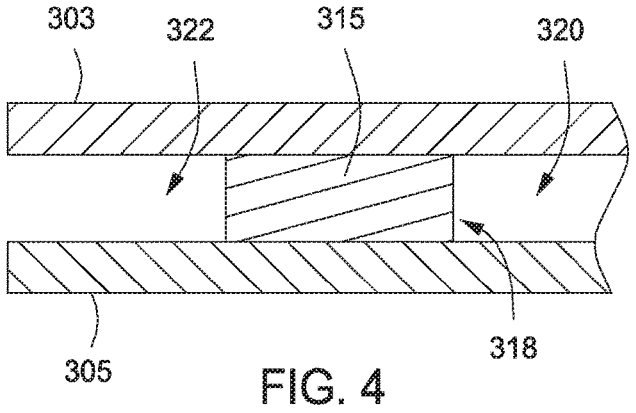
FIG. 4 depicts a schematic cross-sectional view of the paperboard blank depicted in FIG. 3 along line 4-4, according to one or more embodiments described.

FIG. 3 depicts a schematic view of another illustrative paperboard blank 300 for making a cup, according to one or more embodiments, and FIG. 4 depicts a schematic cross-sectional view of the paperboard blank 300 depicted in FIG. 3 along lines 4-4. Referring to FIGS. 3 and 4, the paperboard blank 300 may include a first layer or film 303 and a second layer or substrate 305. The film 303 and the substrate 305 may be secured to one another using any suitable method. For example, the film 303 and the substrate 305 may be at least partially bonded, coupled, affixed, joined, fastened, attached, connected, or otherwise secured to one another with an adhesive 315. In another example, the film 103 and the substrate 305 may be at least partially bonded, coupled, affixed, joined, fastened, attached, connected, or otherwise secured to one another via ultrasonic bonding. In one or more embodiments, the film 303 may be a shrinkable film and the substrate 305 may be a paperboard substrate. The first layer or film 303, the second layer or substrate 305, and the adhesive 315 may be the same or similar to the first layer or film 103, the second layer or substrate 105, and the adhesive 115 discussed and described above with reference to FIGS. 1 and 2.

The paperboard blank 300 may have a first or "top" edge 307, a second or "bottom" edge 309, a third or "left" edge 311, and a fourth or "right" edge 313. The particular shape of the paperboard blank 300 may depend, at least in part, on the particular container to be made from the paperboard blank 300. For example, the paperboard blank 300 depicted in FIG. 3 has arcuate first and second edges 307, 309 and straight third and fourth edges 311, 313 with the first and second edges 307, 309 opposed to one another and the third and fourth edges 311, 313 opposed to one another.

The adhesive 315 may be disposed between the shrinkable film 303 and the paperboard substrate 305. For example, the shrinkable film 303 may be secured to the paperboard substrate 305 with the adhesive 315 about at least a portion of an area or region about a perimeter, e.g., at or adjacent to the edges 307, 309, 311, and 313, of the paperboard substrate 305. In at least one example, the adhesive 315 may be applied about the first edge 307, the second edge 309, the third edge 311, and the fourth edge 313 to form a band of adhesive 315 about the perimeter of the paperboard substrate 305. The adhesive 315 may surround or at least partially surround a first area 320 that may be free or substantially free from the adhesive 315

As shown in FIG. 3, the adhesive 315 along the first edge 307, the second edge 309, and the fourth edge 313 may be at the outer edge or perimeter of the paperboard substrate 305, and the adhesive 315 along the third edge 311 may be set back from, e.g., near but not at, the third edge 311. As such, a second region or area 322 between the third edge 311 and the band of adhesive 315 along the third edge 311 may be free or substantially free from any adhesive. Although not shown, any one or more of the first portion 316, the second portion 317, and the fourth portion 319 of the band of adhesive 315 may also be set back from, e.g., near but not at, the first edge 307, the second edge 309, and the fourth edge 313, respectively.

As shown in FIG. 3, the adhesive 315 along the first edge 307 may extend from the second area 322 along the third edge 311 that may be free or substantially free from the adhesive 315 to the fourth edge 313 and toward the second edge 309 to form a first portion 316 of the band of adhesive 315. The adhesive 315 along the second edge 309 may extend from the second area 322 along the third edge 311 that may be free or substantially free from the adhesive 315 to the fourth edge 313 and toward the first edge 307 to form a second portion 317 of the band of adhesive 315. The adhesive 315 along the third edge 311 may extend from the first portion 316 of the band of adhesive 315 to the second portion 317 of the band of adhesive 315 and from the second area 322 toward the fourth edge 313 to form a third portion 318 of the band of adhesive 315. The adhesive 315 along the fourth edge 313 may extend from the first portion 316 of the band of adhesive 315 to the second portion 317 of the band of adhesive 315 and from the fourth edge 313 toward the third edge 311 to form a fourth portion 319 of the band of adhesive 315. Accordingly, the first portion 316, the second portion 317, the third portion 318, and the fourth portion 319 of the band of adhesive 315 may form a continuous band of adhesive 315 along or about the perimeter of the paperboard substrate 305. Although not shown, it should be appreciated that the band of adhesive 315 does not have to be a continuous band, but may include one or more breaks or discontinuities in the adhesive. As such, the first portion 316, the second portion 317, the third portion 318, and the fourth portion 319 of the band of adhesive 315 may surround or at least partially surround the first area 320 that may be free or substantially free from the adhesive 315.

In one or more embodiments, the width of the area 322, i.e., a distance from the edge 311 to the third portion 318 of the band of adhesive 315, may range from a low of about 0.5 mm, about 1 mm, about 2 mm, or about 3 mm to a high of about 5 mm, about 8 mm, about 10 mm, or about 12 mm or more. In one or more embodiments, the width of the third portion 318 of the band of adhesive 318 located between the first area 320 and the second area 322 may range from a low of about 1 mm, about 2 mm, or about 3 mm to a high of about 5 mm, about 7 mm, about 9 mm, about 11 mm, about 13 mm, or about 15 mm or more.

In one or more embodiments, the second area 322 may be set back from, e.g., near but not at, the fourth edge 313 rather than, or in addition to, being set back from the third edge 311. If the second area 322 is located along the fourth edge 313, the second area 322 may have the same dimensions as those discussed and described for the second area 322 located along the third edge 311.

The first area 320 between the shrinkable film 303 and the paperboard substrate 305, may be free to move away from the paperboard substrate 305 as the shrinkable film 303 shrinks. For example, if the paperboard blank 300 has been formed into a container and the shrinkable film 303 shrinks a gap may be formed between the film 303 and the paperboard substrate 305 as discussed and described in further detail below with reference to FIG. 6.

As shown in FIG. 3, the adhesive 315 may be disposed between the shrinkable film 303 and the paperboard substrate 305 along the first edge 307, the second edge 309, and the fourth edge 313 and along the third edge 311, but set back from the third edge 311 to provide the second area 322 between the third edge 311 and the adhesive 315. As shown in FIG. 4, the shrinkable film 303 may extend to the edge 311 of the paperboard substrate 305. One skilled in the art, however, will appreciate that the shrinkable film 303 may stop or terminate at the edge of the third portion 318 of the band of adhesive 315. One skilled in the art will also appreciate that the shrinkable film 303 may stop or terminate between the edge of the paperboard substrate 305 and the edge of the third portion 318 of the band of adhesive 315.

In one or more embodiments, the width of the band of adhesive 315 or "glue line" disposed between the shrinkable film 303 and the paperboard substrate 305 and along the first edge 307, the second edge 309, and the fourth edge 313 and along, but set back from the third edge 311 may range from a low of about 1 mm, about 2 mm, or about 3 mm to a high of about 5 mm, about 10 mm, about 20 mm, or about 30 mm or more.

In one or more embodiments, the width of the band of adhesive 315 or glue line along each edge 307, 309, 311, and 313 of the paperboard substrate 305 may be the same or different with respect to one another. Said another way, the width of the first portion 316, the width of the second portion 317, the width of the third portion 318, and the width of the fourth portion 319 of the band of adhesive 315 may be the same or different with respect to one another. For example, the width of the band of adhesive 315 along the first edge 307 may be less than the width of the band of adhesive 315 along the second edge 309, less than the width of the band of adhesive 315 along the third edge 311, and/or less than the width of the band of adhesive 315 along the fourth edge 313. In another example, the width of the band of adhesive 315 along the third edge 311 may be less than the width of the band of adhesive 315 along the first edge 307, less than the width of the band of adhesive 315 along the second edge 309 and/or less than the width of the band of adhesive 315 along the fourth edge 313. In another example, the width of the band of adhesive 315 along the fourth edge 313 may be less than the width of the band of adhesive 315 along the first edge 307, less than the width of the band of adhesive 315 along the second edge 309 and/or less than the width of the band of adhesive 315 along the third edge 311. In another example, the width of the band of adhesive 315 along the first edge 307 may be less than the width of the band of adhesive 315 along the third edge 311, which may be less than the width of the band of adhesive 315 along the fourth edge 313, which may be less than the width of the band of adhesive 315 along the second edge 309.

The shrinkable film 303 may shrink when subjected to one or more predetermined triggers or conditions, the same as or similar to the shrinkable film 103 discussed and described above with reference to FIGS. 1 and 2. The shrink force exerted by the shrinkable film 303 during and after shrinking may pull or otherwise exert a force on the paperboard substrate 305 and the adhesive 315 may have a tack or bond strength sufficient to maintain the shrinkable film 303 secured to the paperboard substrate 305, as discussed and described above with reference to FIGS. 1 and 2.

It has been surprisingly and unexpectedly discovered that applying the adhesive 315 along the third edge 311 in a configuration or pattern that forms or provides the second area 322 located between third edge 311 and the third portion 318 of the band of adhesive 315 may significantly reduce or prevent the tendency for the shrinkable film 303 to peel back from the paperboard substrate 305 when the shrinkable film 303 shrinks.

The adhesive 315 may be applied onto the shrinkable film 303 and/or the paperboard substrate 305 to provide the second area 322 and the first area 320 that may be free or substantially free from any adhesive 315 using any suitable method or combination of methods known in the art. For example, the adhesive 315 may be applied to the paperboard substrate 305 via spraying, brushing, flexographic printing, rotogravure printing, offset printing, screen printing, or any other suitable coating method. Suitable methods for applying the adhesive 315 to the shrinkable film 303 and/or the paperboard substrate 305 may also include those discussed and described in U.S. Pat. Nos. 6,536,657; 6,729,534; 7,464,856; 7,614,993; 7,600,669; 7,464,857; 7,913,873; 7,938,313; 7,513,386; 7,510,098; 7,841,974; 8,622,232 and U.S. Patent Application Publication Nos.: 2011/0031305; 2012/0312869; and 2013/0341387.

Figure 5:
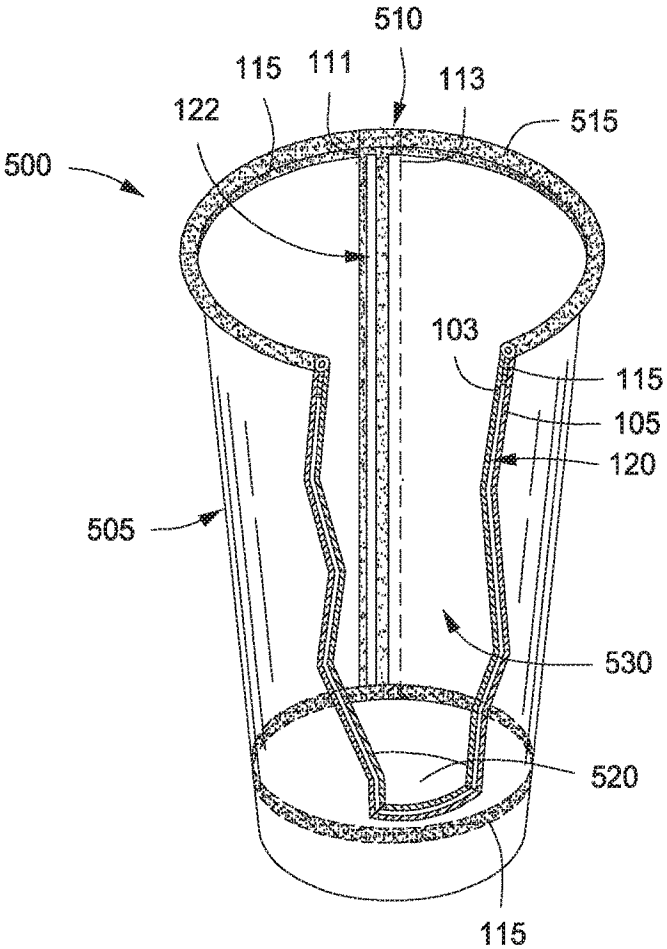
FIG. 5 depicts a partial cut away, perspective view of an illustrative paper cup, according to one or more embodiments described.

FIG. 5 depicts a partial cut away perspective view of a paper cup 500, according to one or more embodiments. The paperboard blank 100 (shown) or 300 (not shown) may be formed, e.g., rolled, folded, bent, curled, or otherwise configured to form a frusto-conical sidewall 505. For example, the third and fourth edges 111, 113 may be overlapped and secured to one another, e.g., via heat sealing, to form the frusto-conical sidewall 505 having a seam 510. The shrinkable film 103 may form or provide at least a portion of an inner surface of the frusto-conical sidewall 505 and the paperboard substrate 105 may form or provide at least a portion of the outer surface of the sidewall 505. As shown in FIG. 5, the shrinkable film 103 has not been shrunk to provide a shrunk film 103.

The sidewall 505 may be formed by rolling, curling, folding, bending, or otherwise placing the third and fourth edges 111, 113 of the paperboard blank 100 depicted in FIG. 1 in contact with one another to form the seam 510. For example, the paperboard blank 100 may be formed around a mandrel to form the seam 510. As such, the first edge 107 may form a first or "top" edge of the sidewall 505 and the second edge 109 may form a second or "bottom" edge of the sidewall 505. If the paperboard substrate 105 is coated with a polymeric material, e.g., polyethylene, the sidewall 505 may be heat sealed or ultrasonically welded to provide a sealed seam 510. The seam 510 may also be sealed with one or more adhesives, e.g., the adhesive 115 or any other adhesive suitable for sealing the third and fourth edges 111, 113 to one another. As shown, the adhesive 115 may be used to secure the shrinkable film 103 to the paperboard substrate 105 along the third and fourth edges 111, 113 and, as such, may be present within the seam 510.

The first edge 107 may be rolled, folded, curled, bent, or otherwise configured to form a brim or "brim curl" 515, which becomes an edge or "top" edge of the sidewall 505. More particularly, to form the brim curl, the edge 107 of the paperboard blank 100 may be rolled, urged, or curled such that the outer or distal end of the edge turns and contacts the paperboard substrate 105 and maintains this position. The brim curl may traverse the perimeter or circumference or only a portion thereof of a first or "top" edge of the paperboard product.

The second edge 109 of the paperboard blank 100 may form a second or "bottom" edge of the sidewall 505. A bottom panel 520 of the paper cup 500 may be disposed on or otherwise secured to the sidewall 505, e.g., proximate or adjacent the second edge of the sidewall, such that the sidewall 505 and the bottom panel 520 define a container volume 530. The bottom panel 520 may be coupled, affixed, joined, fastened, attached, connected, or otherwise secured to the sidewall 505 with the adhesive 115, another adhesive, and/or via other means such as by heat sealing. For example, similar to the paperboard substrate 105, the bottom panel 520 may be coated in a polymeric material capable of forming a seal between the polymeric material, if present, on the paperboard substrate. In one or more embodiments, the second edge 109 may be folded inward and may overlap a rim or one or more tabs extending downward form the bottom panel 520.

The outer and/or inner surface of the sidewall 505 may include one or more printed patterns that may be applied to the paperboard substrate 105. "Printed patterns" and like terminology may refer to ink-printed patterns for aesthetics. Such features, however, may have a functional aspect such as indicating a fill line.

The paper cup 500 may have any suitable container volume 530. For example, the container volume 530 may range from a low of about 20 mL, about 40 mL, about 60 mL, about 80 mL, or about 100 mL to a high of about 120 mL, about 200 mL, about 300 mL, about 400 mL, about 500 mL, about 750 mL, about 1,000 mL, about 1,300 mL, or about 1,500 mL or more. For example, the container volume 530 may be from about 150 mL to about 500 mL, about 450 mL to about 1,000 mL, about 400 mL to about 900 mL, or about 800 mL to about 1,300 mL.

Figure 6:
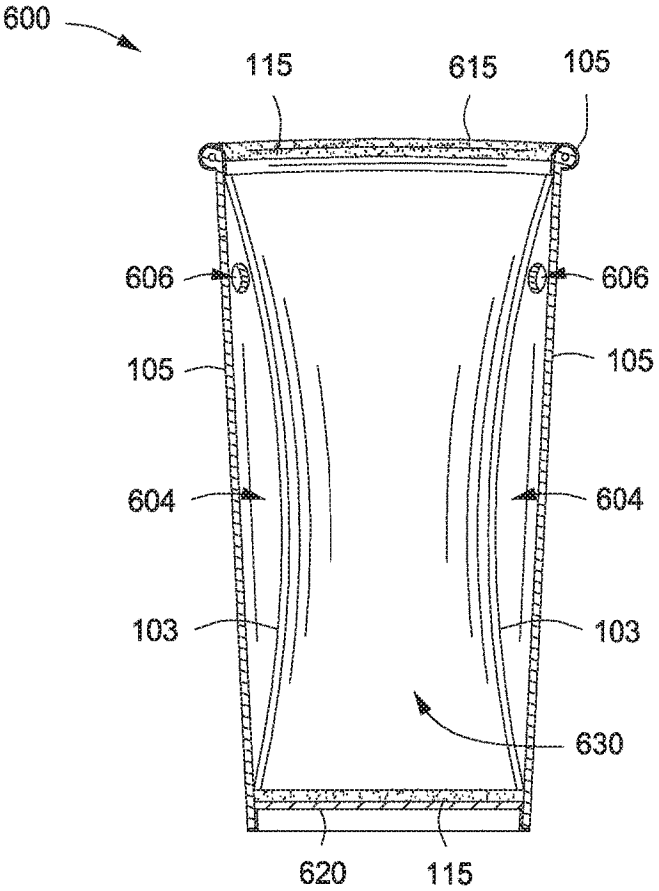
FIG. 6 depicts a cross-section side view of a paper cup having a brim curl, a shrunk film, and a gap formed or located between the shrunk film and the paperboard substrate, according to one or more embodiments described.

FIG. 6 depicts a cross-sectional elevation view of a paper cup 600 having a shrunk film 103 and a gap 604 formed or located between the shrunk film 103 and the paperboard substrate 105, according to one or more embodiments. The paper cup 600 may also include a brim curl 615 and a bottom panel 620. As the shrinkable film 103 shrinks, the gap 604 may be formed between the non-secured portions of the shrinkable film 103 and the paperboard substrate 105. The gap 604 may provide an insulating property to the paper cup 600. For example, a heated liquid having a temperature from a low of about 70° C., about 75° C., or about 80° C. to a high of about 90° C., about 95° C., about 100° C., or about 110° C. or more may be added to the paper cup 600 to cause the shrinkable film 103 to shrink and form the insulating gap 604. The formation or presence of the gap 604 may provide an outer surface of the paper cup 600 that may be insulated from the hot liquid therein. The temperature of the outer surface of the paper cup 600 may be less than about 70° C., less than about 65° C., less than about 60° C., less than about 55° C., less than about 50° C., less than about 45° C., less than about 40° C., or less than about 35° C., when a liquid at a temperature of 95° C. to about 100° C. is contained within the paper cup 600. As such, a person may hold the paper cup 600 containing the heated liquid therein about the outer surface of the container without being burned or otherwise experiencing an unsatisfactory level of discomfort due to the heated liquid within the paper cup 600.

The time required for the shrinkable film 103 to shrink or transition between an initial state to a shrunk state may vary based on one or more factors such as the area of the shrinkable film, the thickness of the shrinkable film, the temperature of the hot fluid placed into contact or otherwise in a heat exchanging relationship with the shrinkable film 103, an amount or flow rate of air or other fluid into a volume or space or "gap" formed between the shrinkable film 103 and the second layer 105 as the shrinkable film 103 shrinks, or combinations of these and/or other factors. As used herein, the term "initial state" refers to the shrinkable film 103 after being secured to the paperboard substrate 105 and after the paper cup 600 has been formed. It should be noted that the shrinkable film 103 may be annealed or otherwise treated or processed during manufacture of the shrinkable film 103 and annealing or otherwise treating the shrinkable film 103 may cause the shrinkable film to shrink some, but not shrink to a maximum amount the shrinkable film 103 is capable of being shrunk.

In one or more embodiments, the amount of time required for the shrinkable film 103 to go from the initial state to the shrunk state may be about 10 seconds or less, about 9 seconds or less, about 8 seconds or less, about 7 seconds or less, about 6 seconds or less, about 5 seconds or less, about 4 seconds or less, about 3 seconds or less, about 2 seconds or less, about 1 second or less, or about 0.5 seconds or less per 100 mL of container volume 530, when a fluid at a temperature of about 70° C. to about 100° C. contacts the shrinkable film 103. For example, the shrinkable film 103 may transition from the initial state to the shrunk state in a time of about 0.5 seconds to 2 seconds per 100 mL of container volume 530, when a fluid at a temperature of about 80° C. to about 100° C. contacts the shrinkable film 103. For example, if the container volume is about 600 mL the shrinkable film 103 may transition from the initial state to the shrunk state in about 3 seconds to about 12 seconds when a fluid at a temperature of about 90° C. contacts the shrinkable film 103.

As shown in FIG. 6, the paperboard substrate 105 (shown) and/or the paperboard substrate 305 (not shown) may include one or more vents (two are shown 606) formed or defined therethrough. The vent 606 may serve as a flow path for air or other gas to flow from a location exterior the paperboard substrate 105 and into the gap 103. While the shrinkable film 103 may shrink without the presence of one or more vents 606, the one or more vents 606 may help the shrinkable film 103 shrink. As the shrinkable film 103 shrinks, a vacuum may be formed between the paperboard substrate 105 and the shrinkable film 103. The presence of a vacuum may reduce and/or prevent the shrinkable film 103 from shrinking or fully shrinking. Having the one or more vents 606 formed through the paperboard substrate may permit air or other fluid to flow into the gap 604 as the shrinkable film 103 shrinks. As such, the formation of the one or more vents 606 through the paperboard substrate 105 may provide a plurality of paper containers, e.g., the paper cup 600, that have shrinkable films 103 that shrink in a more consistent and reliable manner Reliable and consistent shrinkage of the shrinkable film 103 may provide a more commercially desirable product for sale to consumers.

The vent 606 may be cut through the paperboard substrate 105 using a knife, punch, pin, or other rigid apparatus capable of puncturing the paperboard substrate 105. Suitable shapes of the one or more vents 606 may include, but are not limited to, U-shaped vents, large flaps, small flaps, slits, perforations, x-shaped cut-outs, round holes, or any other shape. If two or more vents 606 are formed through the paperboard substrate 105, the shape or configuration and/or size of the two or more vents 606 may be the same or different with respect to one another. In one or more embodiments, the vents 606 may also be formed via burning. Suitable methods form forming the vents 606 via burning may include those discussed and described in U.S. Patent Application Publication No. 2012/0312869.

As the shrinkable film 103 shrinks, the amount of liquid the paperboard container may hold may be reduced. As shown in FIG. 6, the gap 604 occupies a space or volume within the paper cup 600 that would not contain any liquid if liquid were present within the internal volume 630. For example, the container volume 630 may be reduced by about 35% or less, about 30% or less, about 25% or less, about 20% or less, about 15% or less about 10% or less, or about 5% or less with the shrinkable film 103 shrunk and the gap formed 604 as compared to the container volume 630 before the shrinkable film 103 shrinks. Accordingly, the paper cup 600 may be oversized in order to provide a paper cup 600 capable of containing a desired amount of a hot liquid.

FIG. 7 depicts a schematic view of another illustrative paperboard blank 700 for making a cup, according to one or more embodiments, and FIGS. 8 and 9 depict schematic cross-sectional views of the paperboard blank 700 depicted in FIG. 7 along lines 8-8 and lines 9-9, respectively. Referring to FIGS. 7-9, the paperboard blank 700 may include a first layer or film 703 and a second layer or substrate 705.

The film 703 and the substrate 705 may be secured to one another using any suitable method. For example, the film 703 and the substrate 705 may be at least partially bonded, coupled, affixed, joined, fastened, attached, connected, or otherwise secured to one another with an adhesive 715. In another example, the film 703 and the substrate 705 may be at least partially bonded, coupled, affixed, joined, fastened, attached, connected, or otherwise secured to one another via ultrasonic bonding. In one or more embodiments, the film 703 may be a shrinkable film and the substrate 705 may be a paperboard substrate. The first layer or film 703, the second layer or substrate 705, and the adhesive 715 may be the same or similar to the first layers or films 103 and 303, the second layers or substrates 105 and 305, and the adhesives 115 and 315 discussed and described above with reference to FIGS. 1-4.

The paperboard blank 700 may have a first or "top" edge 707, a second or "bottom" edge 709, a third or "left" edge 711, and a fourth or "right" edge 713. The particular shape of the paperboard blank 700 may depend, at least in part, on the particular container to be made from the paperboard blank 700. For example, the paperboard blank 700 depicted in FIG. 7 has arcuate first and second edges 707, 709 and straight third and fourth edges 711, 713 with the first and second edges 707, 709 opposed to one another and the third and fourth edges 711, 713 opposed to one another.

The adhesive 715 may be disposed between the shrinkable film 703 and the paperboard substrate 705. For example, the shrinkable film 703 may be secured to the paperboard substrate 705 with the adhesive 715 about at least a portion of an area or region about a perimeter, e.g., at or adjacent to the edges 707, 709, 711, and 713, of the paperboard substrate 705. In at least one example, the adhesive 715 may be applied about the first edge 707, the second edge 709, the third edge 711, and the fourth edge 714 to form a band of adhesive 715 about the perimeter of the paperboard substrate 705. The adhesive 715 may surround or at least partially surround a first area 720 that may be free or substantially free from the adhesive 715.

The adhesive 715 along the first edge 707 may extend from the third edge 711 to the fourth edge 713 and toward the second edge 709 to form a first portion 716 of the band of adhesive 715. The adhesive 715 along the second edge 709 may extend from the third edge 711 to the fourth edge 713 and toward the first edge 707 to form a second portion 717 of the band of adhesive 715. The adhesive 715 along the third edge 711 may extend from the first portion 716 of the band of adhesive 715 to the second portion 717 of the band of adhesive 715 and toward the fourth edge 713 to form a third portion 718 of the band of adhesive 715. The adhesive 715 along the fourth edge 713 may extend from the first portion 716 of the band of adhesive 715 to the second portion 717 of the band of adhesive 715 and toward the third edge 711 to form a fourth portion 719 of the band of adhesive 715. Accordingly, the first portion 716, the second portion 717, the third portion 718, and the fourth portion 719 may form a continuous band of adhesive 715 about the perimeter of the paperboard substrate 705.

As shown in FIG. 7, the adhesive 715 along the first edge 707, the second edge 709, and the fourth edge 713 may be at the outer edge or perimeter of the paperboard substrate 705. A portion of the adhesive 715 along the third edge 711 may be at the outer edge or perimeter of the third edge 711 and a portion of the adhesive 715 along the third edge 711 may be set back from, e.g., near but not at, a portion of the third edge 711. The adhesive 715 along the third edge 711, e.g., the third portion 718 of the band of adhesive 715, may include a second region or area 722 between the first edge 707 and the second edge 709 that may be free or substantially free from any adhesive 715. As shown in FIG. 7, a portion of the second area 722 may be located within the third portion 718 of the band of adhesive 715 along the third edge 711 at which the adhesive 715 is at the outer edge or perimeter and a portion of the second area 722 may extend from the third edge 711 to the band of adhesive 715. Said another way, a portion of the second area 722 may extend from the third edge 711 to the third portion 718 of the band of adhesive 715 and a portion of the second area 722 may be located within the third portion 718 of the band of adhesive 715 along the third edge 711 of the paperboard substrate 700 and between the first edge 707 and the second edge 709. The portion of the second area 722 that may extend from the third edge 711 to the third portion 718 of the band of adhesive 715 may be closer to the first edge 707 than the second edge 709. The second area 722 may have a shape similar to an upside down and reversed letter "L", e.g., a "]" shape. The second area 722 may be seen as a combination of the second area 122 shown in FIG. 1 and the second area 322 shown in FIG. 3.

The second area 722 may have a length that extends from the first portion 716 of the band of adhesive 715 to the second portion 717 of the band of adhesive 715. As such, the first portion 716, the second portion 717, and the third portion 718 of the band of adhesive 715 may form or otherwise provide a continuous layer or band of the adhesive 715 that extends from the first edge 707 to the second edge 709 that includes the second area 722 partially disposed therein. In one or more embodiments, the second area 722 may extend for a distance that is less than the distance between the first portion 716 of the band of adhesive 715 and the second portion 717 of the band of adhesive 715. For example, the length of the second area 722 may range from a low of about 50%, about 55%, or about 60% to a high of about 90%, about 95%, or about 99% of the distance between the first portion 716 of the band of adhesive 715 and the second portion 717 of the band of adhesive 715. In one or more embodiments, the second area 722 may extend from the first edge 707 to the second portion 717 of the band of adhesive 715, from the second edge 709 to the first portion 716 of the band of adhesive 715, or from the first edge 707 to the second edge 709.

The first area 720 between the shrinkable film 703 and the paperboard substrate 705, may be free to move away from the paperboard substrate 705 as the shrinkable film 703 shrinks. For example, if the paperboard blank 700 has been formed into a container and the shrinkable film 703 shrinks, a gap may be formed between the film 703 and the paperboard substrate 705 as discussed and described in detail above with reference to FIG. 6.

In one or more embodiments, the width of the band of adhesive 715 or "glue line" disposed between the shrinkable film 703 and the paperboard substrate 705 and along the first edge 707, the second edge 709, the third edge 711, and the fourth edge 713 may range from a low of about 1 mm, about 2 mm, or about 3 mm to a high of about 5 mm, about 10 mm, about 20 mm, or about 30 mm or more. In one or more embodiments, the width of the band of adhesive 715 or glue line along each edge 707, 709, 711, and 713 of the paperboard substrate 705 may be the same or different with respect to one another.

The shrinkable film 703 may shrink when subjected to one or more predetermined triggers or conditions, the same as or similar to the shrinkable films 103 and 303 discussed and described above with reference to FIGS. 1-4. The shrink force exerted by the shrinkable film 703 during and after shrinking may pull or otherwise exert a force on the paperboard substrate 705 and the adhesive 715 may have a tack or bond strength sufficient to maintain the shrinkable film 703 secured to the paperboard substrate 705, as discussed and described above with reference to FIGS. 1-4.

It has been surprisingly and unexpectedly discovered that applying the adhesive 715 along the third edge 711 in a configuration or pattern that forms or provides the second area 722 that may include a first portion partially within the third portion 718 of the band of adhesive 715 and that may include a second portion that extends from the third edge 711 to the third portion 718 of the band of adhesive may significantly reduce or prevent the tendency for the shrinkable film 703 to peel back from the paperboard substrate 705 when the shrinkable film 703 shrinks. Additionally, it appears that the shrink forces exerted by the film 703, when the paperboard blank 700 has been formed into a container, e.g., a cup, and the film 703 has been shrunk, allow for increased vertical edge wicking, particularly when a lid is placed on the container. Without wishing to be bound by theory, it is also believed that the configuration or pattern of the second area 722 may reduce or prevent coffee or other liquids from climbing up the sidewall of a formed container, e.g., cup, and over the rim thereof.

The adhesive 715 may be applied onto the shrinkable film 703 and/or the paperboard substrate 705 to provide the second area 722 and the first area 720 that may be free or substantially free from any adhesive 715 using any suitable method or combination of methods known in the art. For example, the adhesive 715 may be applied to the paperboard substrate 705 via spraying, brushing, flexographic printing, rotogravure printing, offset printing, screen printing, or any other suitable coating method. Suitable methods for applying the adhesive 715 to the shrinkable film 703 and/or the paperboard substrate 705 may also include those discussed and described in U.S. Pat. Nos. 6,536,657; 6,729,534; 7,464,856; 7,614,993; 7,600,669; 7,464,857; 7,913,873; 7,938,313; 7,513,386; 7,510,098; 7,841,974; 8,622,232 and U.S. Patent Application Publication Nos.: 2011/0031305; 2012/0312869; and 2013/0341387.

Embodiments of the present disclosure further relate to any one or more of the following paragraphs:

1. A method for making a paper container, comprising: applying a band of adhesive about a perimeter of a paperboard substrate having a first edge and a second edge opposed to one another and a third edge and a fourth edge opposed to one another, wherein the band of adhesive at least partially surrounds a first area that is substantially free from the adhesive, wherein a second area that is substantially free from the adhesive is located between the third edge and the first area, and wherein the first area and the second area are separated by the band of adhesive; securing a shrinkable film to the paperboard substrate with the adhesive to produce a paperboard blank; overlapping the third edge and the fourth edge to form a sidewall, wherein the sidewall comprises: an inner surface comprising the shrinkable film and an outer surface comprising the paperboard substrate, the first edge, and the second edge; securing a bottom panel to the sidewall at or adjacent the second edge; and curling the first edge to form a brim.

2. The method according to paragraph 1, wherein the second area extends from the third edge to the band of adhesive.

3. The method according to paragraph 2, wherein the second area has a width extending from the first edge to the band of adhesive of about 1 mm to about 12 mm.

4. The method according to paragraph 1, wherein the second area is located within the band of adhesive along the third edge of the paperboard substrate and between the first edge and the second edge.

5. The method of according to paragraph 4, wherein the band of adhesive has a width extending from the third edge to an edge of the second area that is closest to the third edge of about 1 mm to about 4 mm.

6. The method according to paragraph 4 or 5, wherein the second area has a width of about 1 mm to about 12 mm.

7. The method according to any one of paragraphs 4 to 6, wherein the band of adhesive has a width extending from the third edge to an edge of the second area that is closest to the third edge of about 1 mm to about 4 mm, wherein the second area has a width extending from the edge closest to the third edge to an edge that is closest to the first area of about 1 mm to about 12 mm, and wherein the band of adhesive along the third edge located between the first area and the second area has a width of about 1 mm to about 15 mm.

8. The method according to any one of paragraph 1 to 7, wherein the band of adhesive along the third edge located between the first area and the second area has a width of about 1 mm to about 15 mm.

9. The method according to any one of paragraph 1 to 8, wherein the shrinkable film comprises a biaxially oriented heat shrinkable polymeric material.

10. The method according to any one of paragraph 1 to 9, wherein the shrinkable film comprises polyethylene, polypropylene, or a mixture thereof.

11. The method according to any one of paragraph 1 to 10, wherein the paperboard substrate comprises a first coating and a second coating disposed on opposing sides of a paperboard layer, and wherein the first and second coatings comprise a polyolefin.

12. The method according to any one of paragraph 1 to 11, wherein the adhesive is applied along the perimeter of the substrate by flexographic printing, rotogravure printing, offset printing, screen printing, or any combination thereof.

13. The method according to any one of paragraph 1 to 12, further comprising forming at least one aperture through the paperboard substrate prior to securing the shrinkable film to the paperboard substrate.

14. A method for making a paper container, comprising: applying a band of adhesive about a perimeter of a paperboard substrate having a first edge and a second edge opposed to one another and a third edge and a fourth edge opposed to one another, wherein the band of adhesive surrounds a first area that is substantially free of the adhesive, and wherein a second area that is substantially free of the adhesive is formed between the third edge and the first area, and wherein the first area and the second area are separated by the band of adhesive; securing a shrinkable film to the paperboard substrate with the adhesive to produce a paperboard blank; overlapping the third edge and the fourth edge to form a sidewall, wherein the sidewall comprises: an inner surface comprising the shrinkable film and an outer surface comprising the paperboard substrate, the first edge, and the second edge; securing a bottom panel to the sidewall at or adjacent the second edge of the sidewall; and curling the first edge of the sidewall to form a brim.

15. The method according to paragraph 14, wherein the first area and the second area are separated by the band of adhesive such that the second area that is substantially free of the adhesive extends about the perimeter of the paperboard substrate.

16. The method according to paragraph 14, wherein the first area and the second area are separated by a portion of the band of adhesive that extends from the first edge to the second edge such that the second area extends from the third edge to the portion of the band of adhesive that extends from the first edge to the second edge.

17. The method according to paragraph 14, wherein the second area extends from the third edge to the band of adhesive that is between the first edge and the second edge a distance of about 1 mm to about 12 mm.

18. The method according to paragraph 14, where the second area is located within the band of adhesive along the third edge of the paperboard substrate and between the first edge and the second edge.

19. A method for making a paper container, comprising: applying a band of adhesive about a perimeter of a paperboard substrate having a first edge and a second edge opposed to one another and a third edge and a fourth edge opposed to one another, wherein the band of adhesive at least partially surrounds a first area that is substantially free from the adhesive, wherein a second area that is substantially free from the adhesive is located between the third edge and the first area, and wherein the first area and the second area are separated by at least a portion of the band of adhesive; securing a shrinkable film to the paperboard substrate with the adhesive to produce a paperboard blank; overlapping the third edge and the fourth edge with one another; heat sealing the third edge and the fourth edge to one another to form a sidewall; securing a bottom panel to the sidewall at or adjacent the second edge; and curling the first edge to form a brim.

20. The method according to paragraph 19, wherein the second area is located within the band of adhesive along the third edge of the paperboard substrate and between the first edge and the second edge.

21. The method according to any one of paragraphs 1 to 20, wherein the paper container is a paper cup.

22. The method according to any one of paragraphs 1 to 21, wherein the sidewall is frusto-conical.

23. The method according to any one of paragraphs 1 to 22, wherein a portion of the second area extends from the third edge to the band of adhesive and a portion of the second area is located within the band of adhesive along the third edge of the paperboard substrate and between the first edge and the second edge.

24. The method according to paragraph 23, wherein the portion of the second area that extends from the third edge to the band of adhesive is closer to the first edge than the second edge.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for making a paper container, comprising:
- applying a band of adhesive about a perimeter of a paperboard substrate, the paperboard substrate having a first edge and a second edge opposed to one another and a third edge and a fourth edge opposed to one another, wherein:
  - the band of adhesive at least partially surrounds a first area that is substantially free from the adhesive,
  - a second area that is substantially free from the adhesive, the second area is located within the band of adhesive along the third edge of the paperboard substrate and between the first edge and the second edge, and
  - the first area and the second area are separated by a portion of the band of adhesive;
- securing a shrinkable film to the paperboard substrate with the adhesive to produce a paperboard blank;
- overlapping the third edge and the fourth edge to form a sidewall, wherein the sidewall comprises:
  - an inner surface comprising the shrinkable film and an outer surface comprising the paperboard substrate,
  - the first edge, and
  - the second edge;
- securing a bottom panel to the sidewall at or adjacent the second edge; and
- curling the first edge to form a brim.

2. The method of claim 1, wherein the second area has a width of about 1 mm to about 12 mm.

3. The method of claim 1, wherein a portion of the band of adhesive that is located between the third edge and the second area has a width of about 1 mm to about 4 mm.

4. The method of claim 3, wherein the second area has a width of about 1 mm to about 12 mm.

5. The method of claim 1, wherein a portion of the band of adhesive that is located between the third edge and the second area has a width of about 1 mm to about 4 mm, wherein the second area has a width of about 1 mm to about 12 mm, and wherein a portion of the band of adhesive that is located between the first area and the second area has a width of about 1 mm to about 15 mm.

6. The method of claim 1, wherein a portion of the band of adhesive that is located between the first area and the second area has a width of about 1 mm to about 15 mm.

7. The method of claim 1, wherein the shrinkable film comprises a biaxially oriented heat shrinkable polymeric material.

8. The method of claim 1, wherein the shrinkable film comprises polyethylene, polypropylene, or a mixture thereof.

9. The method of claim 1, wherein the paperboard substrate comprises a first coating and a second coating disposed on opposing sides of a paperboard layer, and wherein the first and second coatings comprise a polyolefin.

10. The method of claim 1, wherein the adhesive is applied along the perimeter of the substrate by flexographic printing, rotogravure printing, offset printing, screen printing, or any combination thereof.

11. The method of claim 1, further comprising forming at least one aperture through the paperboard substrate prior to securing the shrinkable film to the paperboard substrate.

12. A method for making a paper container, comprising:

applying a band of adhesive about a perimeter of a paperboard substrate, the paperboard substrate having a first edge and a second edge opposed to one another and a third edge and a fourth edge opposed to one another, wherein the band of adhesive is applied at, and in contact with, each of the first, second and fourth edges and applied proximate the third edge, the band of adhesive surrounding a first area that is substantially free of the adhesive and defining a second area that is substantially free of the adhesive between the third edge and the first area, whereby the first area and the second area are separated by a portion of the band of adhesive;

securing a shrinkable film to the paperboard substrate with the adhesive to produce a paperboard blank;

overlapping the third edge and the fourth edge to form a sidewall, wherein the sidewall comprises:

an inner surface comprising the shrinkable film and an outer surface comprising the paperboard substrate, the first edge, and the second edge;

securing a bottom panel to the sidewall at or adjacent the second edge of the sidewall; and curling the first edge of the sidewall to form a brim.

13. The method of claim 12, wherein the second area is located between the third edge and the band of adhesive.

14. The method of claim 12, wherein the first area and the second area are separated by a portion of the band of adhesive that extends from the first edge to the second edge such that the second area extends from the third edge to the portion of the band of adhesive that extends from the first edge to the second edge.

15. The method of claim 12, wherein the second area extends from the third edge to a portion of the band of adhesive that is between the first edge and the second edge and the second area has a width of about 1 mm to about 12 mm.

16. The method of claim 12, wherein the second area is located within the band of adhesive between the third edge of the paperboard substrate and the first area.

17. A method for making a paper container, comprising:

applying a band of adhesive about a perimeter of a paperboard substrate, the paperboard substrate having a first edge and a second edge opposed to one another and a third edge and a fourth edge opposed to one another, wherein the band of adhesive is applied at, and in contact with, each of the first, second and fourth edges and applied proximate the third edge, the band of adhesive surrounding a first area that is substantially free of the adhesive and defining a second area that is substantially free of the adhesive between the third edge and the first area, whereby the first area and the second area are separated by a portion of the band of adhesive;

securing a shrinkable film to the paperboard substrate with the adhesive to produce a paperboard blank;

overlapping the third edge and the fourth edge with one another;

heat sealing the third edge and the fourth edge to one another to form a sidewall;

securing a bottom panel to the sidewall at or adjacent the second edge; and curling the first edge to form a brim.

18. The method of claim 17, wherein the second area is located within the band of adhesive along the third edge of the paperboard substrate and between the first edge and the second edge.

19. The method of claim 17, wherein the second area is located between the third edge of the paperboard substrate and the first area.

20. The method of claim 17, further comprising forming at least one aperture through the paperboard substrate prior to securing the shrinkable film to the paperboard substrate.

* * * * *